US010207855B2

(12) United States Patent
Treadwell

(10) Patent No.: US 10,207,855 B2
(45) Date of Patent: Feb. 19, 2019

(54) ARROWHEAD NOVELTY CADDY

(71) Applicant: Juanita Treadwell, Mesita, CO (US)

(72) Inventor: Juanita Treadwell, Mesita, CO (US)

( * ) Notice: Subject to any disclaimer, the term of this patent is extended or adjusted under 35 U.S.C. 154(b) by 0 days.

(21) Appl. No.: 14/991,947

(22) Filed: Jan. 9, 2016

(65) Prior Publication Data

US 2017/0036829 A1 Feb. 9, 2017

Related U.S. Application Data

(60) Provisional application No. 62/201,453, filed on Aug. 5, 2015.

(51) Int. Cl.
*B65D 81/36* (2006.01)

(52) U.S. Cl.
CPC ..... *B65D 81/365* (2013.01)

(58) Field of Classification Search
CPC ..... A45C 11/00; A45C 11/24; A45C 15/00; B65D 51/245; B65D 81/365
USPC ..... 206/38, 38.1, 457
See application file for complete search history.

(56) References Cited

U.S. PATENT DOCUMENTS

| | | | | | |
|---|---|---|---|---|---|
| 1,385,288 | A * | 7/1921 | Walker | A61C 15/02 | 206/38 |
| 1,486,294 | A * | 3/1924 | Morris | B43K 29/18 | 206/38 |
| 1,794,118 | A * | 2/1931 | Neville | A45D 33/33 | 206/38 |
| D128,625 | S * | 8/1941 | Fischer | 206/38 | |
| 2,276,766 | A * | 3/1942 | De Witt | A61F 17/00 | 206/38 |
| 2,720,307 | A * | 10/1955 | Morgan | B65D 13/00 | 206/37 |
| 3,244,981 | A * | 4/1966 | Der Tatevasian | 206/38 | |
| 8,444,512 | B2 * | 5/2013 | Pierce | A61L 9/12 | 473/578 |
| 8,568,257 | B2 * | 10/2013 | Pierce | F42B 6/08 | 473/581 |
| 9,205,164 | B2 * | 12/2015 | Sanazaro | F42B 6/08 | |
| 9,451,815 | B1 * | 9/2016 | Murray | A45D 40/18 | |
| 9,926,110 | B2 * | 3/2018 | Treadwell | B65D 43/02 | |
| 10,016,038 | B2 * | 7/2018 | Treadwell | A45F 5/02 | |

* cited by examiner

*Primary Examiner* — Bryon Gehman

(57) ABSTRACT

The present invention is a arrowhead novelty caddy. The present invention provides a effective storage of items and a method for attachment(s). In particular, the present invention can be pinned to caps, hats, backpacks, or just about anything that comes to mind; and, the present invention can be placed and held on a magnetically metal surface, such as a refrigerator or in areas where there is a magnetic metal surface. In particular, the present invention provides a user easy access to items.

3 Claims, 3 Drawing Sheets

ARROWHEAD NOVELTY CADDY

The present invention relates to an arrowhead novelty caddy.

BACKGROUND

An arrowhead novelty does not store items and does not allow the novelty to be attached to caps, hats, backpacks, or just about anything that comes to mind; and, an arrowhead novelty does not have a storage chamber element with an attachment member; allowing it to be held on a magnetically metal surface, such as a refrigerator and other things.

Presently there is no solution for people to carry around an arrowhead molded storage-able novelty caddy; and, there is no solution to have easy access to items in another convenient way; held on a magnetically metal surface.

SUMMARY

The present invention seeks to provide a solution to this problem by providing an arrowhead novelty caddy, comprising: a removable cap element to resemble an arrowhead stem, a built-in accessible storage chamber element, and an attachment member, the arrowhead novelty caddy configured so that it is attachable, wherein when the arrowhead stem cap element is operable and closable via a user, a stored item is easily accessible to the user.

The present invention seeks to provide a solution by providing molded an arrowhead novelty caddy which can be attached to caps, hats, backpacks, or just about anything that comes to mind; and, it seeks to provide a solution to this problem by providing the molded arrowhead novelty caddy for easy access to items; where there is the built-in accessible storage chamber element encapsulated in the arrowhead novelty caddy. The present invention can be placed and held on a metal surface, such as a refrigerator.

In particular, the present invention provides the method for storage with a convenient way to carry around the arrowhead novelty caddy. The arrowhead novelty caddy which can be attached to caps, hats, backpacks, or just about anything that comes to mind. In particular, the present invention provides the method for storage and the magnetic method. In particular, the present invention provides a user easy access to items.

The arrowhead novelty caddy; comes with the arrowhead stem cap element.

The arrowhead novelty caddy; provides the built-in accessible storage chamber element.

The arrowhead novelty caddy; provides the attachment member.

The present invention will now be more particularly described, with reference to the accompanying drawings, by way of example only and in no way limiting the scope of the invention, in which.

DETAILED DESCRIPTION

Figure 1:
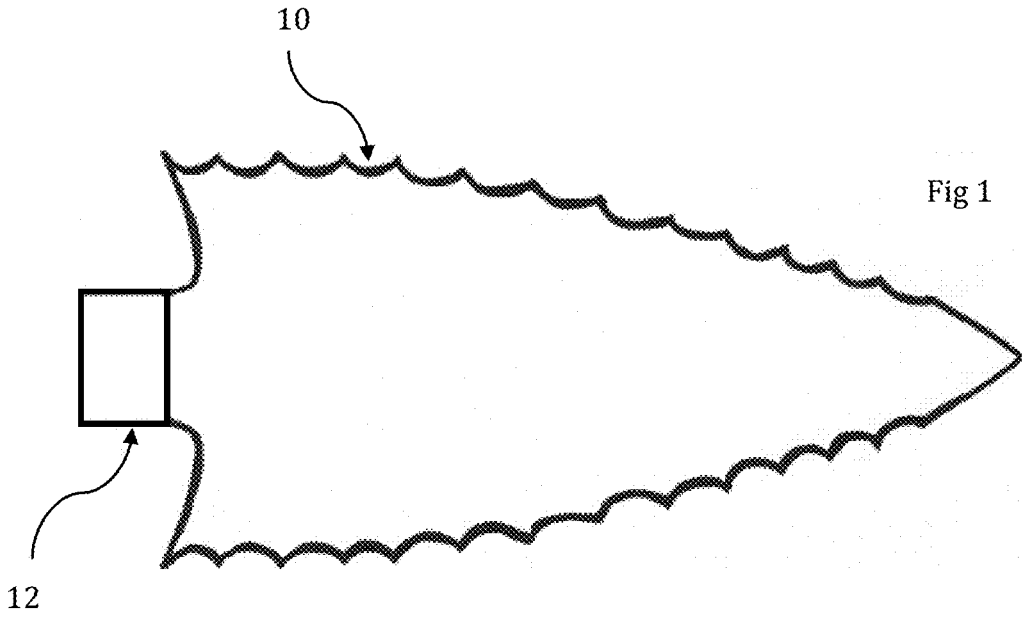
FIG. 1 is a top view of the arrowhead novelty caddy with a particular reference to the arrowhead stem cap element member.
Figure 2:
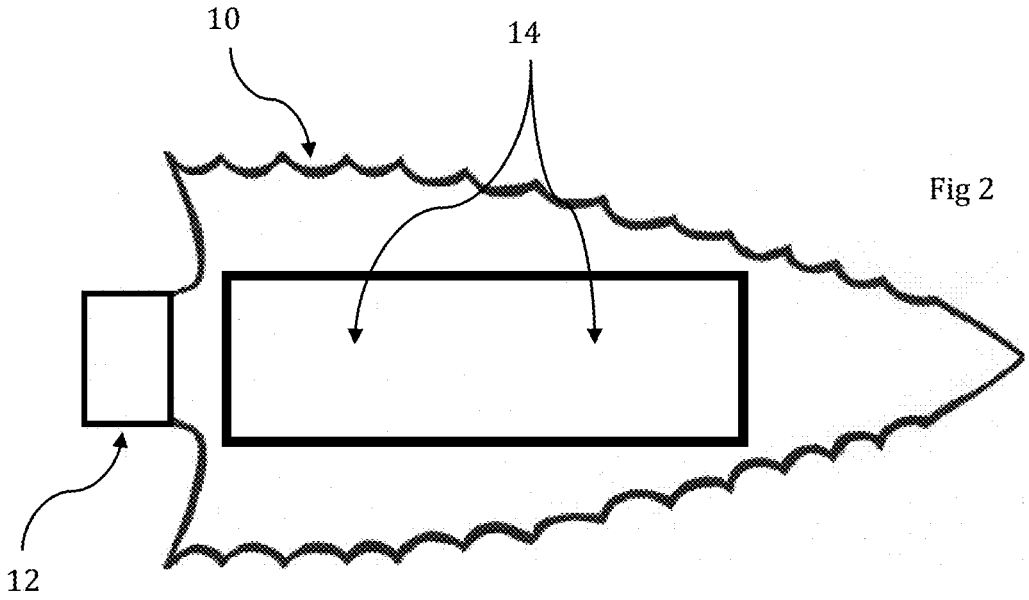
FIG. 2 is a back view of the arrowhead novelty caddy with particular reference to the attachment member.
Figure 3:
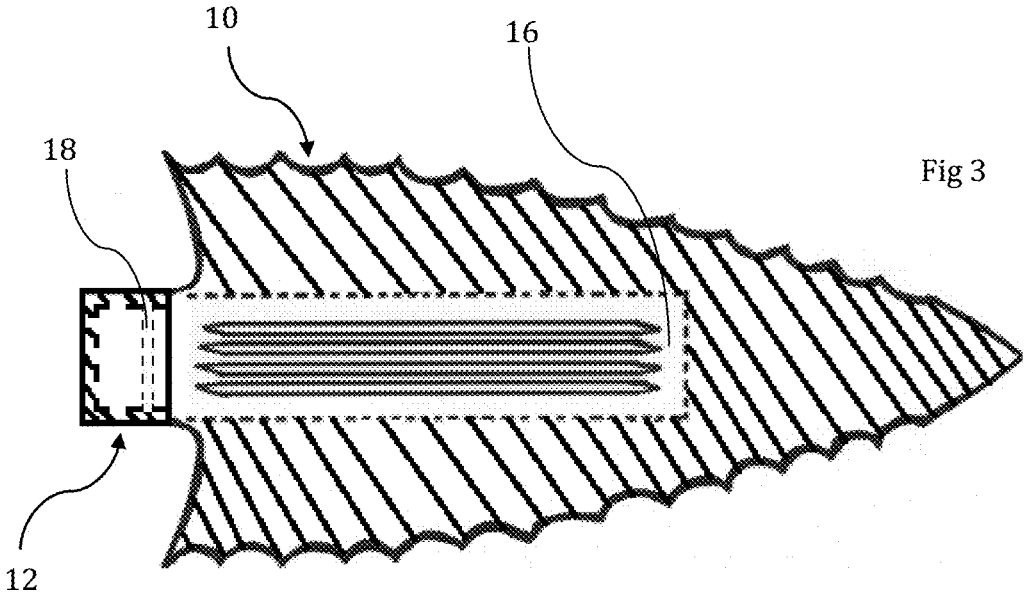
FIG. 3 is a cross-section view of the arrowhead novelty caddy with a slip fit pressed on arrowhead stem cap element combination of the present invention, in which the storage chamber element is filled with toothpicks.
Figure 4:
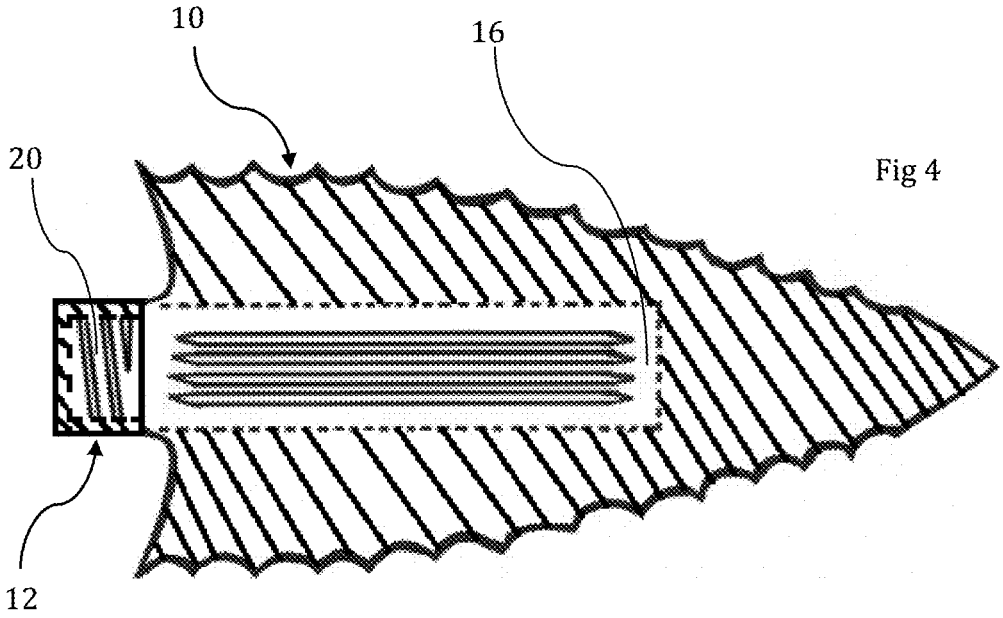
FIG. 4 is a cross-section of the arrowhead novelty caddy with a threaded arrowhead stem cap element combination of the present invention, in which the storage chamber element is filled with toothpicks.
Figure 5:
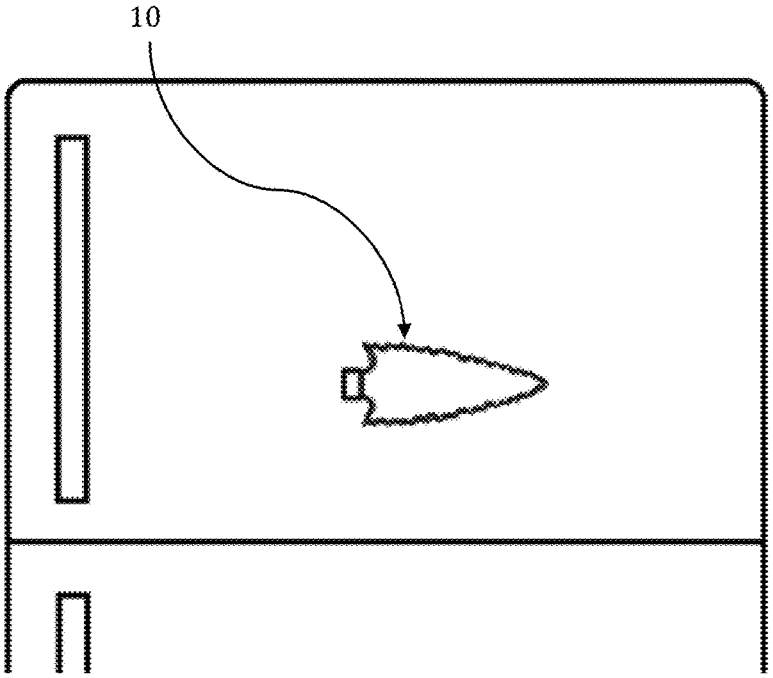
FIG. 5 is a top view of the arrowhead novelty magnetic caddy on a refrigerator.
Figure 6:
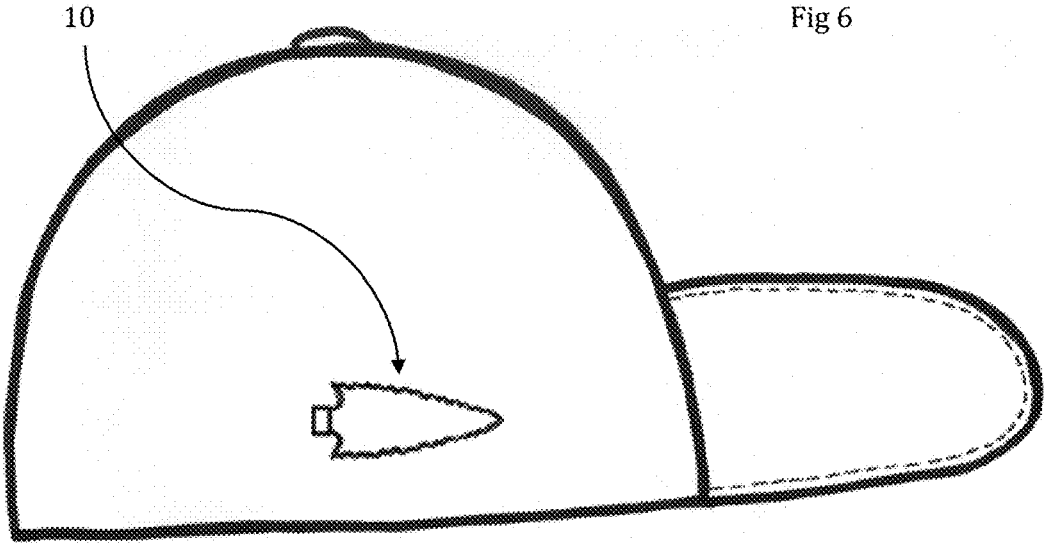
FIG. 6 is a top view of the arrowhead novelty caddy attached to a baseball cap.

Referring to the drawings, there is shown the arrowhead novelty caddy 10, comprising: the removable arrowhead stem cap 12 element; the attachment member 14; and the built-in accessible storage chamber 16 element; the arrowhead novelty caddy 10 configured so that it is attachable, wherein when the arrowhead stem cap 12 element is openable and closable via a user, a stored item is easily accessible to the user.

There is shown the detachable arrowhead stem cap 12 element configured to resemble an arrowhead stem for accessing the storage chamber 16 element located within the arrowhead novelty caddy 10.

Referring to the attachments member 14 is for illustration purposes only.

The built-in accessible storage chamber 16 element is to hold and transport items.

Referring to the slip fit press on 18.

Referring to the threads 20.

The invention will now be described in use, with reference to a preferred embodiment, in no way limiting a scope of the invention.

In use, when the arrowhead novelty caddy is attached to a cap, hat, backpack, or just about anything that comes to mind, the user no longer has to go searching for an item; and, when in use such as placed and held on a metal surface such as a refrigerator the arrowhead novelty caddy provides the user easy access to an item.

Without the invention the user would have to go looking for the item.

The embodiments described above are provided by way of example only, and various other modifications will be apparent to persons skilled in the art without departing from the scope of the invention as defined in the appended claims.

The invention claimed is:

1. A molded arrowhead novelty caddy, comprising:

a molded element shaped to resemble an arrowhead;

the molded element including a built-in storage chamber;

a detachable stem cap, configured to close the storage chamber and, when closing the storage chamber, the stem cap is disposed so as to provide an arrowhead stem to the molded element arrowhead shape; the caddy further including at least one attachment member.

2. The arrowhead novelty caddy, as claimed in claim 1, wherein the removable arrowhead stem cap element is at least one of:

a slip fit cap;

a press on cap; and a threaded cap.

3. The arrowhead novelty caddy as claimed in claim 1, wherein the at least one attachment member is at least one of:

tie tacks;

hook and loop material;

glue; and magnets.

* * * * *